United States Patent [19]

Sainsbury et al.

[11] Patent Number: 4,900,266

[45] Date of Patent: Feb. 13, 1990

[54] STRAIN RELIEF SYSTEM FOR CONNECTING CABLES

[75] Inventors: John D. Sainsbury, Unionville, Canada; Edward Karkow, Glen Arm, Md.

[73] Assignee: GSI Corporation, Timonium, Md.

[21] Appl. No.: 320,423

[22] Filed: Mar. 8, 1989

[51] Int. Cl.[4] ..... H01R 13/58

[52] U.S. Cl. ..... 439/451; 439/76

[58] Field of Search ..... 439/76, 449, 451, 452

[56] References Cited

U.S. PATENT DOCUMENTS

| | | | |
|---|---|---|---|
| 1,705,075 | 3/1929 | Stoddard | 439/452 |
| 4,070,083 | 1/1978 | DiPalma | 439/452 |
| 4,234,146 | 11/1980 | Shima et al. | 248/63 |
| 4,449,012 | 5/1984 | Voser | 174/70 A |
| 4,638,117 | 1/1987 | Ney | 174/117 F |

*Primary Examiner*—Gary F. Paumen

*Attorney, Agent, or Firm*—Fetherstonhaugh & Co.

[57] ABSTRACT

A cable and connector assembly in which a longitudinally elongated cable is connected to a connector housing by means of strain bearing cables which have a substantially higher modulus of elasticity than that of the cable conductors. Each strain bearing cable has a free end portion projecting from the free end of the sheath and located laterally outwardly from and arranged one on either side of the free end portions of the conductors. A first conductor connection point is located on the connector member at which an end of the free end portion of the conductor is connected to the connector member. A pair of strain bearing cable connection points on the connector member, each of the strain bearing cable connection points is located laterally outwardly from and one on either side of the first connection point. The free end portions of the strain bearing cables are connected, one at each strain bearing cable connection point, to the connector member in a manner such that any slack which is provided in the free end portions of the strain bearing cables is less than that provided in the free end portion of the conductor such that substantially all of a tensile load applied to the conductor member by a load applied to the cable assembly will be transmitted to the connector member through the strain bearing cables at the strain bearing cable connection points.

9 Claims, 2 Drawing Sheets

STRAIN RELIEF SYSTEM FOR CONNECTING CABLES

This invention relates to a cable and connector assembly.

In particular, this invention relates to a strain relief system for a cable and connector assembly which will serve to prevent separation of the conductors and the connector member in response to a tensile load applied to the cable.

PRIOR ART

Signal conducting cables are usually connected to a connector member such as a plug member or a socket member. Frequently, when the connector member to which the cable is attached is to be separated from a further connector member with which it is mated, a tensile load is applied through the cable to the connector member. This tensile load can damage the connections made between the conductors of the cable and the connector. In many applications such as in a flat cable of the type used in computers and the like, the conductors are very thin and can be easily broken or damaged by the tensile loads applied to the cable when attempting to separate mated connectors. This problem is particularly acute with flat cables because the tensile loads which are applied are rarely applied in a truely axial direction and as a result, the tensile load is not evenly spread over all of the conductors. Consequently, the conductor which bears the greatest portion of the load is likely to be damaged.

Attempts have been made to overcome this problem be ensuring that the sheath of the cable is held fast with respect to the connector member. The sheath of many cables and in particular, the sheath of flat cables is relatively thin and elastic and consequently even if the free end of the sheath is held tightly by the connectors, the tensile loads applied to the cable can very easily cause the sheath to stretch and thus apply a tensile load to the conductors.

European Patent No. 66910 discloses discloses a flat cable which includes two steel cables for absorbing longitudinal tractive forces. There is, however, no disclosure in this patent which indicates that these cables are in any way connected to the connector member to which the conductors are attached.

U.S. Pat. No. 4,449,012, Voser, discloses a telephone cable in which Kevlar threads are used, however, the patent does not locate the Kevlar threads at opposite sides of the conductors and there is no indication as to how these threads are attached to a connector.

U.S. Pat. No. 4,234,146 discloses a flat type cable in which suspension cords are embedded. These suspension cords are, however, located between adjacent rows of conductors.

U.S. Pat. No. 4,638,117 discloses an electrical cable in which tension absorbing elements are located centrally between two spaced parallel conductors. Any tensile load applied to this cable in a direction other than axially of the cable would result in a greater load being applied to one or other of the conductors.

SUMMARY OF INVENTION

According to one aspect of the present invention, there is provided a cable and connector assembly comprising a longitudinally elongated cable assembly comprising a sheath having a free end, a conductor extending within said sheath and having a free end portion projecting from the free end of said sheath, a pair of strain bearing cables extending within said sheath, said strain bearing cables having a substantially higher modulus of elasticity than that of the conductor, each strain bearing cable having a free end portion projecting from the free end of said sheath, the free end portions of the strain bearing cables being located laterally outwardly from and arranged one on either side of the free end portion of the conductor, a conductor member having first connector means located thereon adapted to cooperate with complimentary second conductor means to form an electrical connection therebetween in use, first conductor connection point on said connector member at which an end of the free end portion of said conductor is connected to the connector member and through which it communicates with said first connector means, a pair of strain bearing cable connection points on said connector member, each of said strain bearing cable connection points being located laterally outwardly from and one on either side of said first connection point, the free end portions of the strain bearing cables being connected, one at each strain bearing cable connection point, to the connector member in a manner such that any slack which is provided in the free end portions of the strain bearing cables is less than that provided in the free end portion of the conductor such that substantially all of a tensile load applied to the connector member by a load applied to the cable assembly will be transmitted to the connector member through the strain bearing cables at the strain bearing cable connection points.

BRIEF DESCRIPTION OF THE DRAWINGS

The invention will be more clearly understood after reference to the following detailed specification read in conjunction with the drawings wherein.

DETAILED DESCRIPTION OF THE INVENTION

Figure 1:
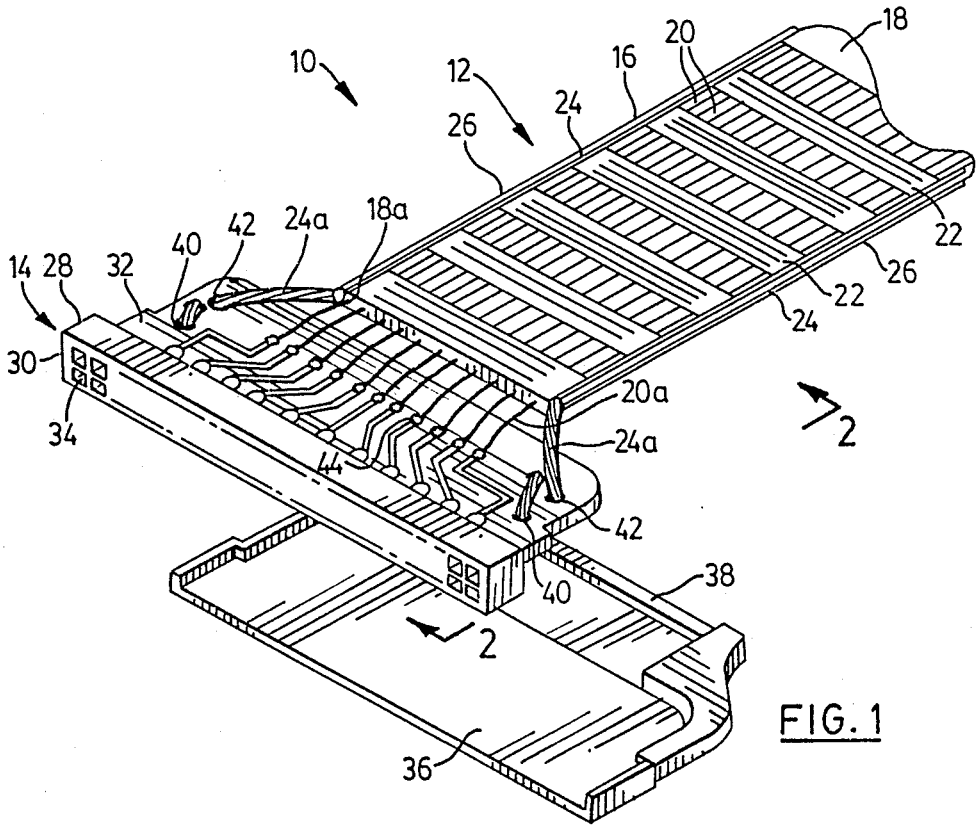
FIG. 1 is a partially exploded pictorial view of a cable and connector assembly constructed in accordance with an embodiment of the present invention.
Figure 2:
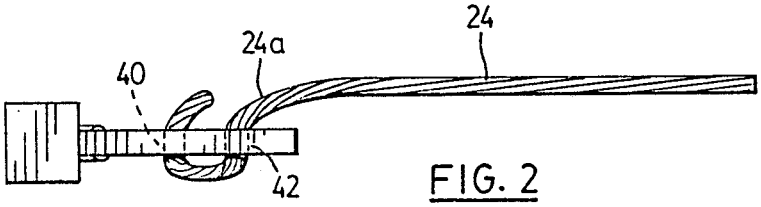
FIG. 2 is a side view of the connector showing the manner in which the strain bearing cables are attached to the printed circuit board portion of the connector.

With reference to FIG. 1 of the drawings, the reference numeral 10 refers generally to a cable and connector assembly constructed in accordance with an embodiment of the present invention which comprises a cable assembly 12 and a connector assembly 14.

The cable assembly 12 comprises a flat cable 16. The flat cable 16 comprises a sheath 18 in which a plurality of conductors 20 are embedded so that they extend in a spaced parallel relationship. Each of the conductors 20 has a free end portion **20*a* which projects from the free end 18*a* of the sheath 18. A plurality of transfers reinforcing straps 22 are provided which extend across the sheath 18**.

A pair of strain bearing cables 24 are embedded in and extend longitudinally of the oppositely disposed side edges 26 of the cable.

Each of the strain bearing cables 24 has a free end portion **24*a* which projects from the free end of the cable 18*a***.

The connector assembly 14 comprises a connector member 28 which consists of a head portion 30 and a printed circuit board portion 32. A plurality of sockets 34 are formed in the head portion 30 of the connector member of the illustrated embodiment. It will, however, be understood that plug elements may be provided in place of the sockets 34 in a complimentary connector member.

A protective shell is formed in two mating halves, one of which is identified by the reference numeral 36. The shell 36 has a bar portion 38 which extends along one edge thereof which cooperates with a corresponding bar on the mating protective shell (not shown) to clamp the sheath 18 of the cable therebetween when the protective shell segments 38 are operably positioned.

The circuit board member 32 is formed with two pair of passages 40 and 42 which serve to receive the free end 24*a* of the strain bearing cables 24. The free end portions 20*a* of the conductors 20 are attached in a conventional manner to the traces 44 on the printed circuit board.

The free ends 24*a* of the strain bearing cables 24 are threaded through the passages 42 and 40 and are bonded by means of an adhesive or the like to the circuit board member 32. The free ends 24*a* may also be tied in a knot after being threaded through the passages 40 and 42 so that the free ends are held fast with respect to the circuit board member 32.

It will be noted that the passages 40, 42 are spaced laterally outwardly from the oppositely disposed side edges of the flat cable 16 and as a result, the free end portions 24*a* are angularly inclined with respect to the side edges of the flat cable as they extend toward the passages 42. In addition, when making the connection between the strain bearing cables 24 and the circuit board member 32, care is taken to ensure that any slack which is provided in the free end portions 24*a* of the strain bearing cables 24 is less than the slack provided in the free end portions 20*a* of the conductors such that substantially all of the tensile load applied to the connector member 14 by a tensile load applied to the cable will be transmitted to the connector member through the strain bearing cables.

Because the connection points at which the free ends 24*a* are spaced laterally outwardly from the side edges of the flat cable, when a tensile load is applied to the flat cable which is nonaxial with respect to the cable, the cable will be deflected toward one side from the position shown in FIG. 1 and will tend to align with one or other of the angularly inclined free end portions 24*a* of the strain bearing cables and as a result, this one strain bearing cable will carry the major portion of the tensile load applied to the cable and will transmit this load directly to the circuit board member 32, thus preventing the application of a substantial load to the connection points of the free ends 20 and the traces 44.

The strain bearing cables 24 are made from a material which has a higher modulus of elasticity than the remainder of the components of the cable assembly including the sheath 18 and the conductors 20. Kevlar (trade mark) thread is a suitable material for use as a strain bearing cable.

From the foregoing, it will be apparent that the present invention provides a cable and connector assembly in which the likelihood of damage to the electrical connection formed between the conductors and the connector member by reason of a tensile load applied to the cable is greatly reduced. This invention is of particular importance when applied to a flat cable in which the conductors extend longitudinally of the cable in a spaced parallel relationship and are therefore very susceptible to damage by reason of a tensile load applied directly in the cable.

Figure 3:
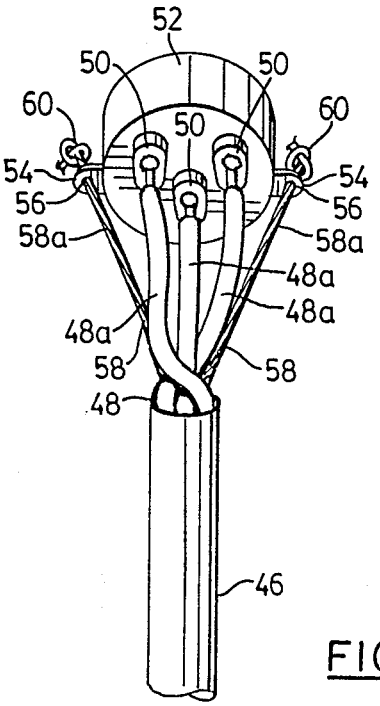
FIG. 3 is a pictorial view of a cable and connector assembly constructed in accordance with a further embodiment of the present invention.

As indicated in FIG. 3, however, the invention is also applicable to a structure having a cable of circular cross-section such as that identified by the reference numeral 46. The cable 46 has conductors 48 which have free end portions 48*a*, the ends of which are soldered to pins 50 of a connector 52 which again may be in the form of a plug or a socket connector. A pair of lugs 54 project laterally from and are rigidly secured with respect to the body of the connector 52. Passages 56 are formed in the lugs 54. A pair of strain bearing cables 58 have free end portions 58*a* which extend through the passages 56 and the portion thereof which extends beyond the passage 56 is knotted to provide a knot 60 which is sufficiently large to ensure that it cannot pass through the passage 56. Again, it will be noted that the free ends 58*a* are angularly inclined from the free end of the sheath to their connection points with the connector 52 and in addition, the slack which is provided in the free end portions 58 is less than the slack provided in the free ends of the connectors 48*a*. As a result, the connection which is formed between the connector 52 and the cable assembly is such that substantially all of the tensile load likely to be applied to the cable 46 in use will be transmitted by the strain bearing cables 58 to the connector 52 and this will serve to reduce the likelihood of damage to the connection formed between the conductors and their connection points on the connector member 52.

Although, as previously indicated, there are advantages to the arrangement which is illustrated in FIGS. 1 and 3 where the strain bearing cables diverge from the free end of the cable to their connection point with the connector member, it will be understood that connection points may be located in line with the strain bearing cables, such that they extend parallel to one another and parallel to the conductors when extending from the free end of the cable to the connection points. In a further modification of the embodiment illustrated in FIG. 1, the flat cable may be connected to a connector which does not include a printed circuit board and in such a case, the strain bearing cables will be connected directly to the housing in a manner similar to that illustrated in FIG. 3.

From the foregoing, it will be apparent that the present invention provides a simple and inexpensive cable and connector assembly which greatly reduces the likelihood of damage to the assembly as a result of the application of a tensile load to the cable when attempting to separate the connector member from its mated connector. These and other advantages of the present invention will be apparent to those skilled in the art.

We claim:

1. A cable and connector assembly comprising:

(a) a longitudinally elongated cable assembly comprising;

(i) a sheath having a free end, (ii) a conductor extending within said sheath and having a free end portion projecting from the free end of said sheath, (iii) a pair of strain bearing cables extending within said sheath, said strain bearing cables having a substantially higher modulus of elasticity than that of the conductor, each strain bearing cable having a free end portion projecting from the free end of said sheath, the free end portions of the strain bearing cables being located laterally outwardly from and arranged one on either side of the free end portion of the conductor, (b) a connector member having first connector means located thereon adapted to cooperate with complimentary second connector means to form an electrical connection therebetween in use, a first conductor connection point on said connector member at which an end of the free end portion of said conductor is connected to the connector member and through which it communicates with said first connector means, a pair of strain bearing cable connection points on said connector member, each of said strain bearing cable connection points being located laterally outwardly from and one on either side of said first connection point, the free end portions of the strain bearing cables being connected, one at each strain bearing cable connection point, to the connector member in a manner such that any slack whch is provided in the free end portions of the strain bearing cables is less than that provided in the free end portion of the conductor such that substantially all of a tensile load applied to the connector member by a load applied to the cable assembly will be transmitted to the connector member through the strain bearing cables at the strain bearing cable connection points, wherein said cable assembly is a flat cable which has oppositely disposed side edges and said connector member is a flat connector member, said strain bearing cables being embedded in said flat cable and arranged one adjacent each of said oppositely disposed side edges.

2. A cable and connector assembly as claimed in claim 1, wherein said strain bearing cable connection points are spaced laterally outwardly from the side edges of the flat cable and the free end portions of the strain bearing cables are angularly inclined from the free end of the sheath to their connection point on the connector member so as to be predisposed to assume a tensile load applied to the cable assembly in a direction which is inclined with respect to the longitudinal extent of the cable assembly.

3. A cable and connector assembly as claimed in claim 1, wherein said connector member comprises a printed circuit board on which said connection points are located.

4. A cable and connector assembly as claimed in claim 3, further comprising a protection shell which engages the sheath of the cable assembly and serves to hold the sheath fast with respect to the printed circuit board.

5. A cable and connector assembly as claimed in claim 1, wherein said strain bearing cables are made from Kevlar.

6. A cable and connector assembly as claimed in claim 1, further comprising a plurality of conductors and a plurality of conductor connection points on said connector member, said conductor connection points each being located between said strain bearing connection points.

7. A cable and connector assembly as claimed in claim 1, wherein said strain bearing cables are tied to the connector member at said strain bearing cable connection points so as to be held fast with respect to the connector member.

8. A cable and connector assembly as claimed in claim 1, wherein said strain bearing cables are bonded to the connector member at said strain bearing cable connection points.

9. A cable and connector assembly as claimed in claim 1, wherein said cable assembly has a predetermined width, said strain bearing cable connection points being laterally spaced from one another to an extent which is greater than the predetermined width of the cable assembly such that the free end portions of the strain bearing cables are angularly inclined from the free end of the sheath to the connection points so as to be predisposed to assume a tensile load applied to the cable assembly in a direction which is inclined with respect to the longitudinal extent of the cable assembly.

* * * * *